United States Patent [19]

Toone et al.

[11] Patent Number: 4,590,590

[45] Date of Patent: May 20, 1986

[54] SONOBUOY MULTIPLE DEPTH DEPLOYMENT APPARATUS

[75] Inventors: James R. Toone, Fort Wayne; Robert L. Barker, Ossian, both of Ind.

[73] Assignee: Magnavox Government and Industrial Electronics Company, Fort Wayne, Ind.

[21] Appl. No.: 555,979

[22] Filed: Nov. 29, 1983

[51] Int. Cl.[4] ..... B63B 21/52

[52] U.S. Cl. ..... 367/4; 441/25; 441/33

[58] Field of Search ..... 367/4; 441/7, 24, 25, 441/33

[56] References Cited

U.S. PATENT DOCUMENTS

| | | | |
|---|---|---|---|
| 3,262,090 | 7/1966 | Farmer | 367/4 |
| 3,786,403 | 1/1974 | Will et al. | 367/4 |
| 3,991,475 | 11/1976 | Segrest et al. | 441/24 |
| 4,464,130 | 8/1984 | Ouellette et al. | 367/4 X |

*Primary Examiner*—Richard A. Farley

*Attorney, Agent, or Firm*—Thomas A. Briody; William J. Streeter; Richard T. Seeger

[57] ABSTRACT

A sonobuoy float canister is releasably latched to a wound cable pack container. The cable is attached at its upper end to the canister and at its lower end to a lower sonobuoy component. A rotor latches the canister and container together in one rotative position so that the cable is not unwound or payed out to provide a first or shallow depth deployment of the lower component. In a second rotative position of the rotor the canister and container are unlatched from one another and the cable is positively restrained after a predetermined partial payout to provide a medium depth deployment of the lower component. In a third rotative position of the rotor the positive restraint of cable payout is removed and the canister and container are unlatched so that the cable is fully payed out to provide for full depth deployment of the underwater component.

11 Claims, 20 Drawing Figures

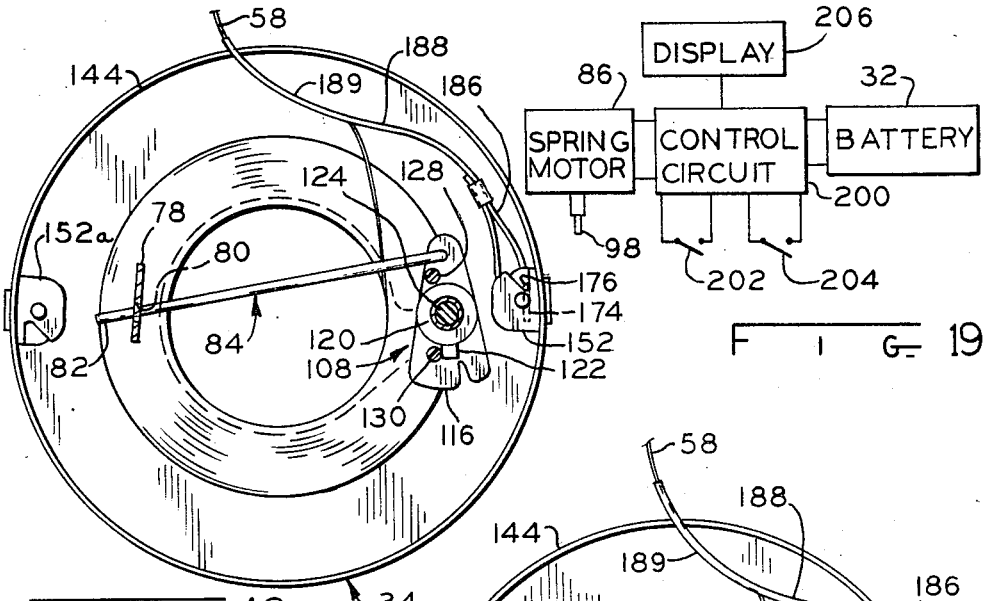
FIG. 19
FIG. 16
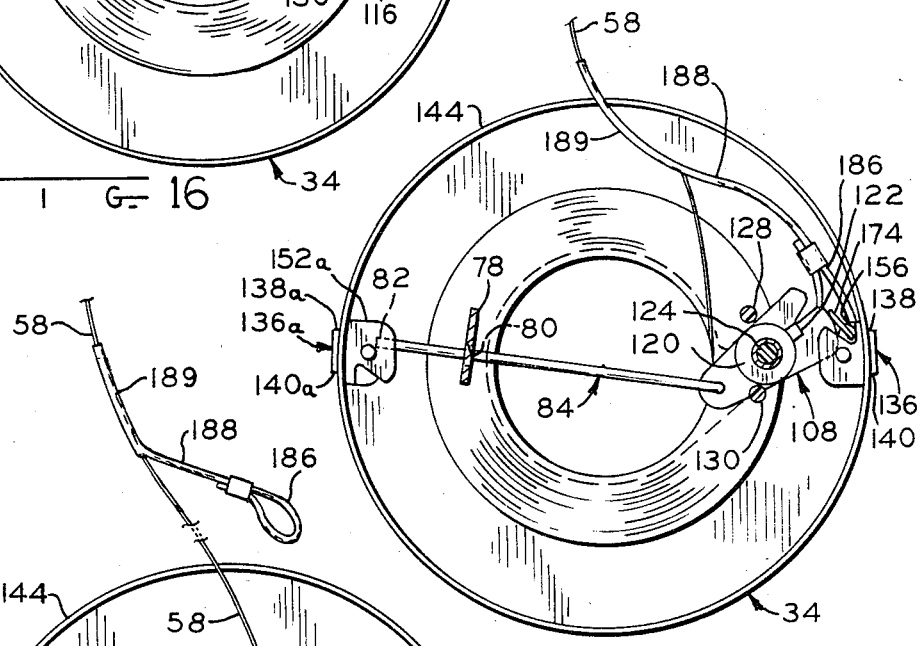
FIG. 17
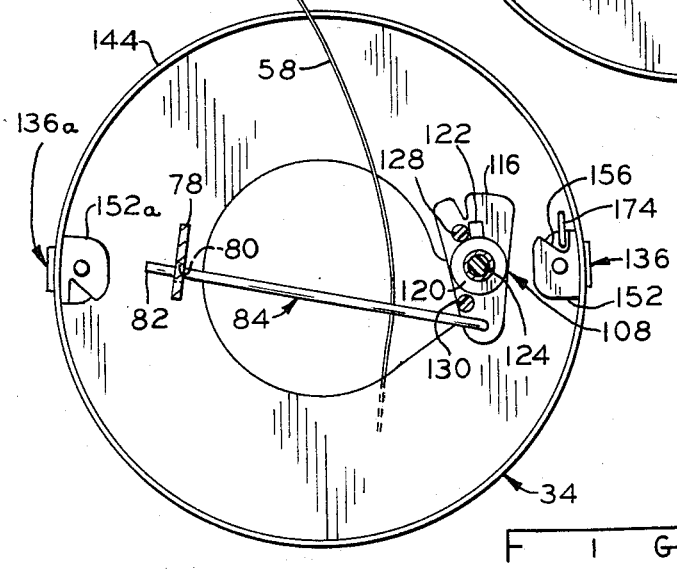
FIG. 18

SONOBUOY MULTIPLE DEPTH DEPLOYMENT APPARATUS

BACKGROUND OF THE INVENTION

1. Field of the Invention

This invention relates to sonobuoy deployment apparatus and more particularly to preselected depth deployment of the sonobuoy hydrophone.

2. Brief Statement of the Prior Art

Sonobuoys are devices adapted to be dropped by parachute from an aircraft, are equipped with an hydrophone for detecting underwater sounds in either an active or passive manner and transducing the sounds to electrical signals and have an automatic radio transmitter for transmitting the signals to air and surface craft. A wound cable packed in the sonobuoy connects the surface transmitter and the underwater hydrophone and is automatically payed out after the sonobuoy enters the water. The cable length determines the underwater depth of the hydrophone. Different cable lengths are desired for different water bottom depths and other conditions.

One manner of obtaining different depths is simply to package a wound cable having a length desired for a particular application. Each sonobuoy thus is restricted to only one hydrophone depth. A sonobuoy capable of multiple hydrophone deployment depths substantially increases the sonobuoy versatility and reduces sonobuoy logistic requirements and this invention is directed towards this purpose.

SUMMARY OF THE INVENTION

A sonobuoy float canister is releasably latched to a cylindrical wound cable pack container. The cable is attached at one end to the float and at the other end to a lower sonobuoy component. The cable is provided with a looped end lanyard attached to the cable at a predetermined point intermediate of the cable length corresponding to a predetermined intermediate depth of the underwater component. The looped end of the lanyard extends above the wound cable and is releasably captured as later explained.

A bidirectionally rotatable cam or wedge-shaped rotor is mounted to the bottom end of the float canister and pivotally carries at its narrow end a rod end. The rod extends across the canister bottom and its other end is movable into and out of latched contact with the underside of a first lip inwardly extending from the inner surface of the cable pack container. The wide end of the rotor is movable into and out of latched contact with the underside of a second lip inwardly extending from the inner surface of the cable pack container at a point diametrically opposite the first lip. The rod end and rotor wide end are latched and unlatched substantially simultaneously.

A "P" shaped wire has its shank rotatably mounted at two spaced points on a vertical axis in a bracket depending from the second lip on the inside surface of the container and is spring urged upwardly. The wide end of the rotor is notched to receive the head of the P wire and swings the head about the vertical axis as the rotor turns. The second lip has a notch at one side thereof for receiving the head of the P wire and the rotor can swing the head into the lip notch. The shank of the P wire is inserted through the looped end of the lanyard and thus the looped end is captured as long as the wire is in the bracket, between the mounting points.

In the first, or center, rotative position of the rotor, the rod end is latched to the first lip, the rotor is latched to the second lip and the looped end of the lanyard is captured by the shank of the P wire. The canister is thus latched to the container and no payout of the cable is possible and this corresponds to a first or shallow deployment depth of the lower component. In a second rotative position of the rotor, the rotor is rotated away from the lip notch so that the looped end of the lanyard remains captured and the rod end and rotor wide end are unlatched from their respective lips, thus releasing or unlatching the canister from the container. The cable pays out to the point where the lanyard is attached but no further since the looped end of the lanyard is still captured. This corresponds to the medium or intermediate deployment depth. In a third rotative position of the rotor the rotor is rotated towards the lip notch and the head of the P wire is swung into alignment with the lip notch at which point the head of the P wire is spring urged into the notch and against the bottom end of the canister releasing the looped end of the lanyard and continued rotation of the rotor to the third position will also unlatch the canister from the container. The cable is fully payed out since the restraint has been removed and the underwater component is deployed to the full length of the cable.

A bidirectional motor is used to selectively obtain the rotational positions of the rotor. The motor is actuated through a control circuit which initiates the actuation sequence when a salt water battery is flooded with a sea water electrolyte. To obtain the first rotative position of the rotor the motor is unactuated. To obtain the second rotative position of the rotor the motor is actuated in one rotational direction and to obtain the third rotative position the motor is actuated in the opposite rotational direction.

It is therefore an object of this invention to provide a sonobuoy deployment apparatus having a plurality of selectable hydrophone deployment depths utilizing a rotor that is operable in opposite rotational directions to obtain respective selected depths.

Another object of this invention is to provide apparatus of the previous object wherein one deployment depth corresponds to no payout of the deployment cable between upper and lower sonobuoy components, a second depth corresponds to partial payout of the cable and a third depth corresponds to full payout of the cable.

Another object of this invention is to provide in the apparatus of the previous object apparatus for latching together of the upper and lower sonobuoy components thus preventing cable payout which apparatus is unlatched in a first manner to provide partial cable payout and unlatched in a second manner for full cable payout.

A further object of this invention is to provide in the apparatus of the previous object a looped end lanyard attached to an intermediate point in the cable with the looped end captured in the first manner of unlatching and freed in the second manner of unlatching.

The above mentioned and other features and objects of this invention and the manner of obtaining them will become more apparent and the invention itself will be best understood by reference to the following description of an embodiment of the invention taken in conjunction with the accompanying drawings.

BRIEF DESCRIPTION OF THE DRAWINGS

FIG. 16 is a view similar to FIG. 15 with the release mechanism rotor shown in a second rotative position corresponding to the second deployment depth;

FIG. 17 is a view similar to FIG. 15 with the release mechanism rotor shown in a rotative position wherein the looped end of the lanyard is released;

FIG. 18 is a view similar to FIG. 15 with the release mechanism rotor in a third rotative position corresponding to the third deployment depth;

FIG. 19 is a schematic diagram of the control circuit mounted in the float canister for actuating the rotor motor.

DESCRIPTION OF A PREFERRED EMBODIMENT

Figure 1:
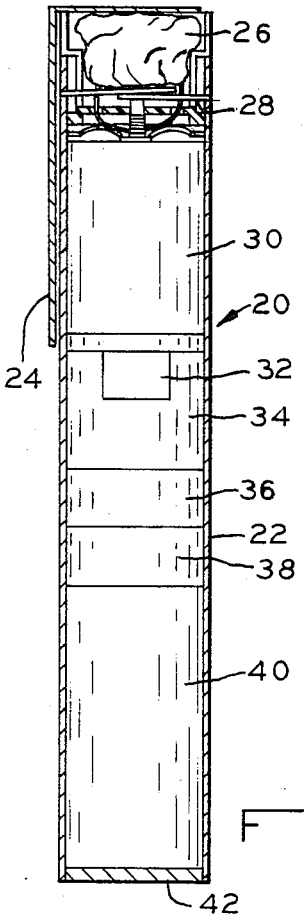
FIG. 1 is a vertical section, shown diagrammatically, of a sonobuoy utilizing the mechanism of this invention.
Figure 2:
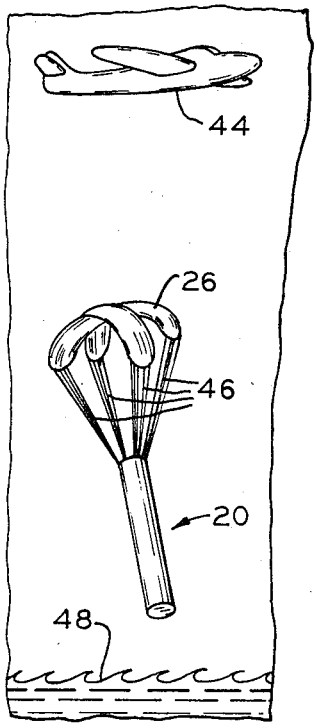
FIG. 2 is a perspective view of a sonobuoy of FIG. 1 with the parachute deployed and about to enter the water after being released from an aircraft.

Referring to FIGS. 1–6 a sonobuoy 20 prior to deployment has cylindrically tubular outer casing 22, wind blade 24 at the outside upper end thereof and inside thereof in descending order parachute 26, parachute release mechanism shown generally at 28, cylindrical rigid float canister 30, sea water battery 32, upper compliance cable and hard cable pack container 34, electrically conductive lower compliance cable 36, sea anchor 38, lower electronic components and hydrophone container 40 and removable lower end 42. Sonobuoy 20 is dropped from aircraft 44 and blade 24 is wind actuated in conventional manner to deploy parachute 26, having a plurality of shroud lines 46 which are releasably attached inside casing 22, to provide a controlled descent to the surface of water 48.

After casing 22 enters water 48 parachute 26, lines 46, and parachute cup 50 attached to the lower ends of lines 46 are ejected and the buoyancy force of canister 30 causes separation of canister 30 from casing 22. Antenna 52 is automatically extended from canister 30 and extends above the surface of water 48 for transmission of signals from hydrophone 54, which may be active or passive as is known in the art. One manner of ejecting parachute 26, lines 46 and cup 50 is disclosed in commonly owned copending application Ser. No. 555,978, filed Nov. 29, 1983 by Robert L. Barker and entitled "Sonobuoy Retaining and Release Mechanism".

Canister 30 is connected to upper end of electrically conductive upper compliance cable 56 the lower end of which is connected to the upper end of electrically conductive hard cable 58 the lower end of which is connected to the upper end of lower compliance cable 36. Cables 56, 36 are relatively short and resilient to reduce vibration and shock while cable 58 is longer and is dimensioned to provide the desired fully deployed or deep depth of hydrophone 54.

The lower end of cable 36 is connected to the top of anchor 38 the lower end of which is connected to hydrophone 54. In the deployed condition shown in FIG. 4, casing 22 is free of its previous contents and sinks to the bottom which is facilitated by release of end 42.

Figure 4:
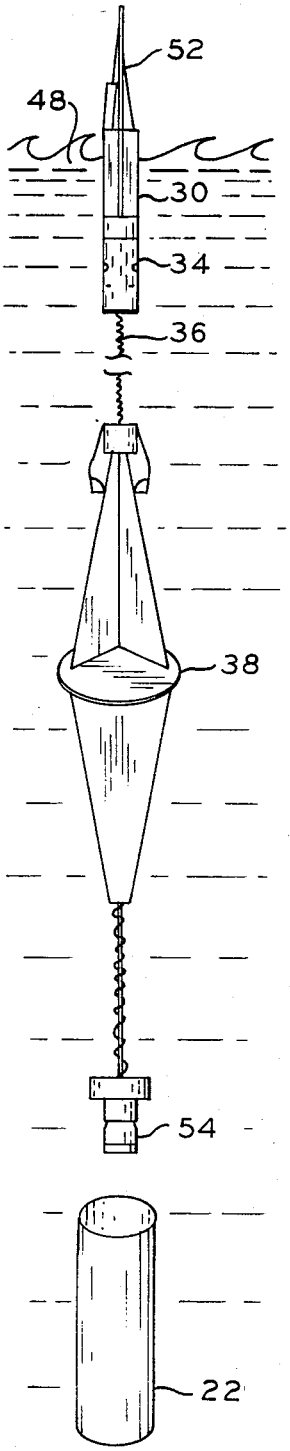
FIG. 4 is a simplified, partially in perspective and partially broken view of a sonobuoy in a first or shallow depth deployment.
Figure 5:
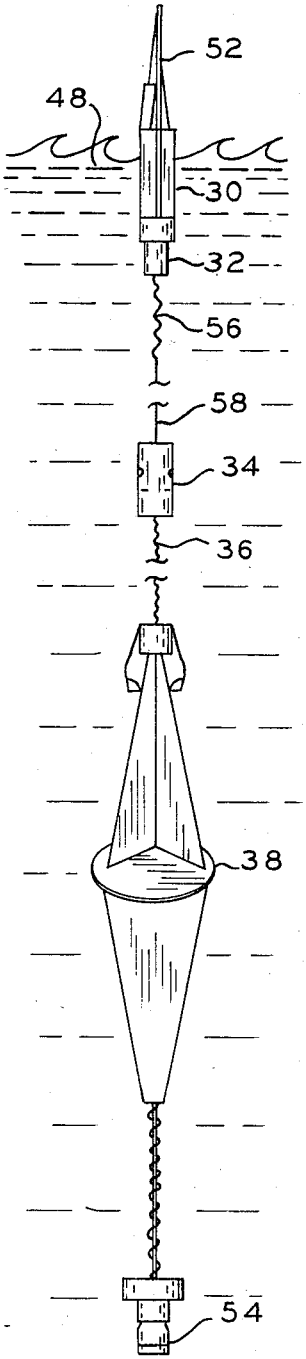
FIG. 5 is a view similar to FIG. 4 of the sonobuoy in a second or medium depth deployment.
Figure 6:
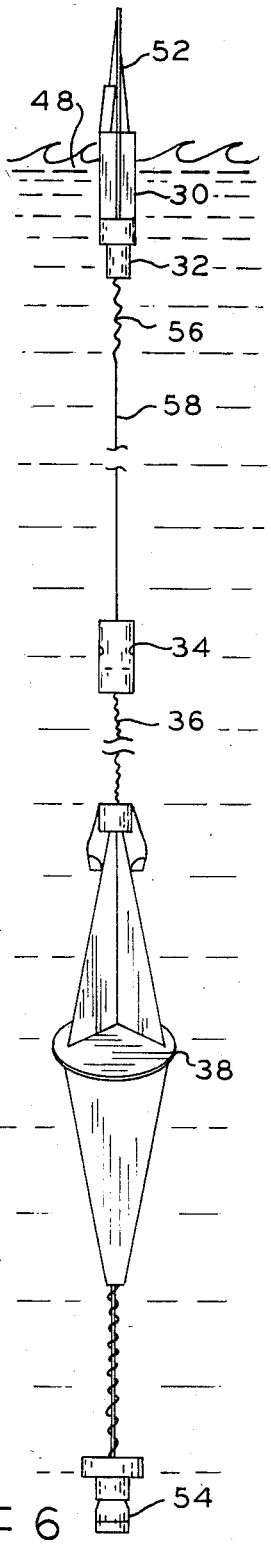
FIG. 6 is a view similar to FIG. 4 of the sonobuoy in a third or deep depth deployment.

In FIG. 4 hydrophone 54 is deployed to the shallow or first depth, canister 30 being latched to container 34; in FIG. 5 hydrophone 54 is deployed to a medium or second depth, canister 30 being unlatched from container 34 and cable 58 being partially payed out; and in FIG. 6 hydrophone 54 is deployed to a deep or third depth with canister 30 being unlatched from container 34 and cable 58 being fully payed out.

Figures 7, 8, 9, 10:
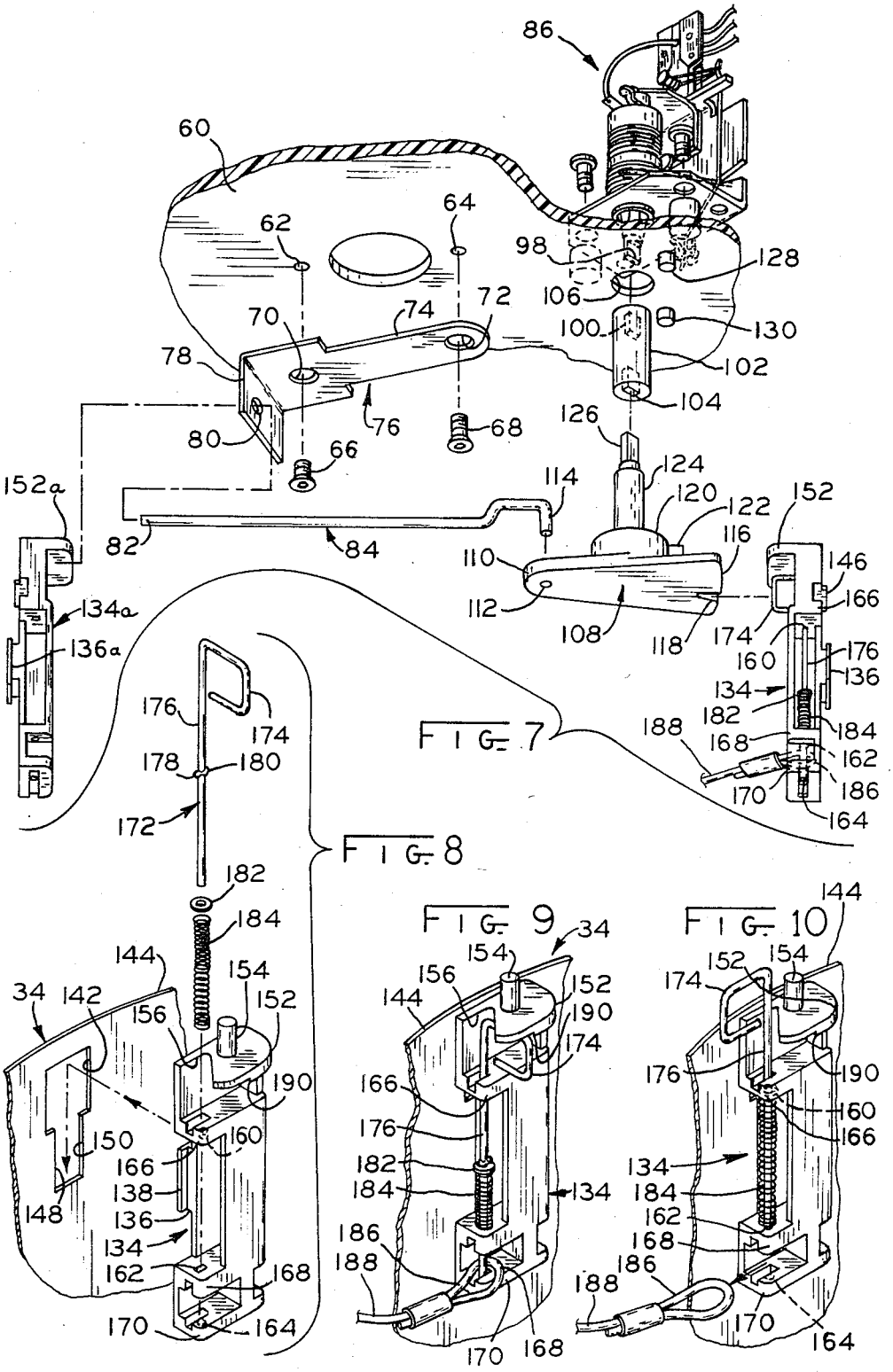
FIG. 7 is an exploded perspective view of the mechanism of this invention used to obtain the selectable multiple depth deployment.
FIG. 8 is an enlarged exploded perspective partially broken view of the lanyard retention and release mechanism of this invention.
FIG. 9 is an enlarged perspective partially broken view of the mechanism of FIG. 8 mounted to the cable pack container inner surface and showing the looped end of the lanyard in a retained or captured condition.
FIG. 10 is a view similar to FIG. 9 showing the looped end in a released condition.

Referring to FIG. 7 the unlatching and release mechanism is shown. Bottom end 60 of canister 30 is provided with holes 62, 64 for receiving rivets 66, 68 respectively which are inserted through holes 70, 72 respectively in horizontal leg 74 of L-shaped rod guide bracket 76. Bracket 76 has depending arm 78 with guide hole 80 for slidingly receiving end 82 of latching rod 84 for guiding movement of rod end 82 beneath lip **152*a* and maintaining latching pressure between lip 152*a* and rod end 82. A sea water activated battery powered bidirectional spring motor 86 of the kind disclosed in commonly owned prior filed copending application Ser. No. 06/555,517, filed Nov. 28, 1983 by Gerald W. Braun and entitled "One Shot Spring Activated Motor", now U.S. Pat. No. 4,494,024, issued Jan. 15, 1985, the subject matter of which application is incorporated herein by reference may be used with this invention. Motor 86 is attached to openings in posts 90, 92 upstanding from the upper surface of bottom 60 with bolts 94, 96. Motor 86 is capable of selectively rotating in either the clockwise or counterclockwise rotative direction through an arc of approximately 135°. Other bidirectional motors of similar function may be used. Motor 86 has depending shaft key 98 which is inserted in upper keyway 100 of cylindrical coupler 102 which has lower keyway 104. Coupler 102 is rotatably mounted in opening 106 in bottom 60**.

Wedge shaped rotor 108 has a pointed or narrow end 110 in which is formed opening 112 for receiving, for free rotation therein, downturned end 114 of rod 84. Wide end 116 of rotor 108 has funnel shaped notch 118 formed therein slightly off center of end 116. Cylindrical base 120 is formed on and upstanding from the upper surface of rotor 108 substantially centrally thereof. A stop finger 122 extends radially outwardly from base 120 towards end 116 substantially midway between the sides of end 116. Cylindrical post 124 is formed on and upstanding from base 120 and key 126 is formed on and upstanding from post 124 and is received in keyway 104. Thusly motor 86 rotatively drives rotor 108 through coupler 102. Stops 128, 130 depend from the lower surface of bottom 60 and are positioned in the swing path of finger 122 as rotor 108 is rotated clockwise and counterclockwise respectively to limit the rotative arc of rotor 108.

Referring to FIGS. 7–9 elongated vertical slide bracket 134 has extending from the outer side thereof substantially square slide 136 having vertical ears 138, 140 on opposite sides thereof. Slide 136 is insertable into the upper square shaped portion of T-shaped slot 142 in wall 144 of container 34. As slide 136 is moved downwardly in slot 142, slot edges 148, 150 slide along the inner surfaces of ears 138, 140 respectively until horizontal ledge 146 which is vertically spaced spaced above slide 136 clears the upper edge of slot 142 and snaps into the square opening at the top of slot 142 at which point bracket 134 is firmly attached to wall 144.

An inwardly extending lip 152 is formed in bracket 134 and has vertical locator peg 154 upstanding therefrom which is insertable into a locator opening, not shown, in bottom 60. A V-shaped notch 156 is formed at one side of lip 152 adjacent wall 144 and between the first and third rotative positions of rotor 108. Vertically spaced below lip 152 in bracket 134 in vertically spaced alignment are pivot holes 160, 162, 164 in laterally projecting arms 166, 168, 170 respectively. P shaped wire 172 has square shaped looped head 174, is of a stiff material such as rigid metal wire, and shank 176 depends from head 174. Formed on shank 176 are a pair of spring washer retaining tabs 178, 180. Shank 176 is slidingly inserted downwardly through hole 160, is slidingly inserted through the center opening of downwardly convex shaped washer 182 the upper surface of which abuts and is restrained from further sliding movement on shank 176 by tabs 178, 180 and slidingly inserted through coil spring 184. The end of shank 176 is slidingly inserted through hole 162 compressing spring 184 between washer 182 and arm 168, FIG. 9, and then through loop 186 at the end of lanyard 188 and then into hole 164. Head 174 is turned counterclockwise, as viewed from the top, until it abuts shallow positioning shoulder 190 formed on the underside of lip 152 at which point head 174 is positioned for insertion into notch 118, FIG. 15, and maintaining compression of spring 184.

Diametrically opposite bracket 134 in wall 144 is a similar bracket **134*a* inserted in a T shaped slot 142*a* in wall 144 similar to T slot 142 in a similar manner. Bracket 134*a* has lip 152*a* extending inwardly of container 34 in the manner of lip 152. Slide 36*a*, ears 138*a*, 140*a* and ledge 146*a* of bracket 134*a* are all similarly shaped and function in similar manner to the corresponding parts of bracket 134 to firmly attach bracket 134*a* to the inner surface of wall 144. As will become apparent bracket 134*a* is utilized for the purpose of providing inwardly extending lip 152*a* for latching canister 30 to container 34. Bracket 134*a* is shaped similarly to bracket 152** for reasons of economy of manufacture.

Figure 11:
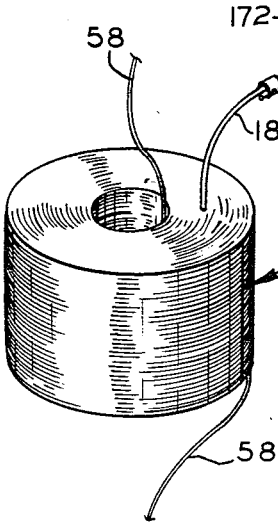
FIG. 11 is a perspective view of the fully wound cable pack coil showing the lanyard protruding from the upper end and the P shaped wire inserted through the looped end as it is for the first depth deployment.
Figure 12:
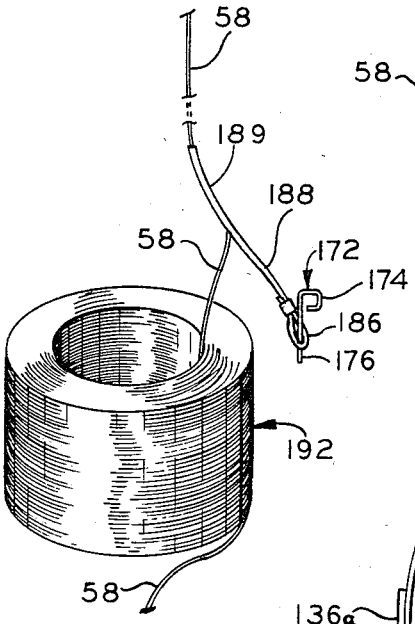
FIG. 12 is a view similar to FIG. 11 with the cable pack coil partially payed out and restrained from further pay out by the lanyard end retention by the P wire as it is for the second depth deployment.
Figure 13:
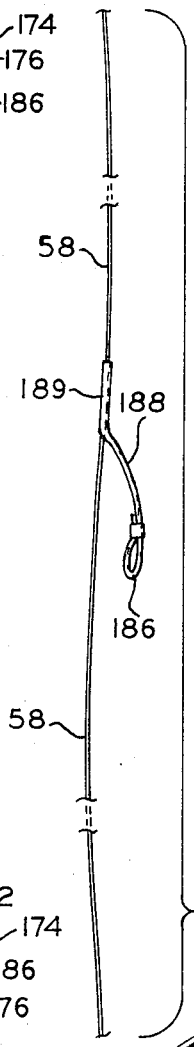
FIG. 13 is a view similar to FIG. 11 with the lanyard end released and the coil fully payed out as it is for the third depth deployment.

Referring to FIGS. 11–13 cable 58 is wound in a multiple layer coil 192 and when fully wound, FIG. 11, cable portions extend above and below coil 192. Lanyard 188 extends above coil 192 from a point between coil ends. Loop 186 is shown diagrammatically around shank 176 of P wire 172. As mentioned, coil 192 remains fully wound for the first depth deployment.

In the partially payed out condition of coil 192, FIG. 12, coil 192 is unwound from the inside to the outside until lanyard 188 becomes taut, being restrained from further payout by the restraining force applied to loop 186 by shank 176. This condition of coil 192 corresponds to the second deployment depth. Lanyard 188 in this embodiment is a woven tubular fabric having a portion 189 through which cable 58 is inserted and progressively contracts in diameter and tightens on cable 58 as cable 58 is pulled through portion 189 in a payout direction to firmly attach portion 189 to cable 58. A weave of this kind is well known and is sometimes referred to as a "Chinese finger".

In the fully payed out condition of coil 192, FIG. 13, coil 192 is fully unwound, the restraining force of shank 176 on loop 176 having been removed, as later explained. This condition of coil 192 corresponds to the third deployment depth.

Figure 14:
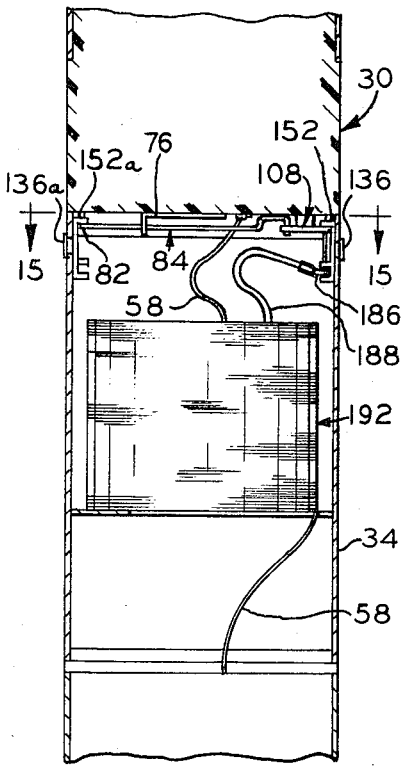
FIG. 14 is a partial, simplified longitudinal section of the float canister latched to the cable pack container.
Figure 15:
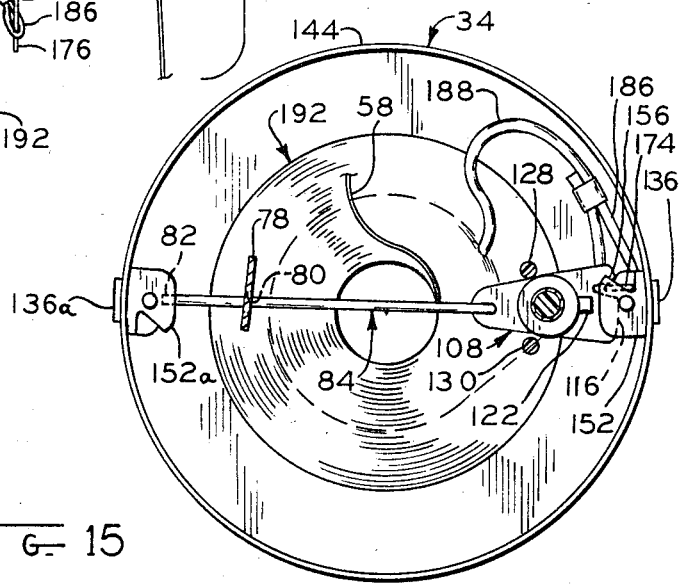
FIG. 15 is an enlarged section taken at 15—15 of FIG. 14 with the release mechanism rotor shown in a first rotative position corresponding to the first deployment depth.

Referring to FIGS. 14–18, canister 30 is latched to container 34, FIGS. 14, 15, is unlatched from container 34 with loop 186 captured by shank 176, FIG. 16, is latched to container 34 with lanyard loop 186 released by shank 176, FIG. 17, and is unlatched from container 34 after loop 186 has been released from shank 176, FIG. 18.

Rotor 108 is in a first rotative or center position in FIGS. 14, 15 wherein rod end 82 is underneath lip **152*a* and rotor end 116 is under lip 152 latching canister 30 to container 34. Head 174 is in notch 118 and also is under lip 152. In this condition, no cable 58 payout from coil 192 is possible and hydrophone 54** is at the first deployment depth.

In the second rotative position of rotor 108, FIG. 16, rotor 108 has been rotated approximately 90° in the counterclockwise direction, viewed from above, from the first rotative position at which point finger 122 abuts stop 130. End 82 is moved clear of lip **152*a* and end 116 is moved clear of lip 152 by the rotation of rotor 108. Head 174 has been swung clockwise and shank 176 has been rotated clockwise about the vertical axis of shank 176 by the rotation of rotor 108. Head 174 is still under lip 152 so that no upward movement of shank 176 has taken place and loop 186 is still captured by shank 176 between arms 168, 170. Thus canister 30 is unlatched from container 34 and cable 58 payout from coil 192 occurs until the point at which lanyard 188 is attached to cable 58 is reached whereat further payout is prevented since loop 186 is still captured by shank 176. Lanyard portion 189 may be attached to any point on cable 58 in coil 192** so that the second deployment depth may be varied as desired.

In the third rotative position, FIG. 18, of rotor 108 motor 86 has rotated rotor 108 approximately 90° clockwise from the first rotative position until finger 122 abuts stop 128. End 82 is moved clear of lip **152*a* and end 116 is moved clear of lip 152 thereby unlatching canister 30 from container 34. During the rotation of rotor 108, head 174 is swung counterclockwise and shank 176 has been rotated counterclockwise about the vertical axis of shank 176 by the rotation of rotor 108, head 174 sliding under lip 152 until it reaches notch 156, FIG. 17, at which time it is spring urged upwardly through notch 156 against bottom 60, with shank 76 moving upwardly under the force of spring 184 a distance sufficient to clear the vertical distance between arm 170 and arm 168 releasing loop end 186, FIG. 10. Full payout of coil 192 occurs, FIG. 13**, to obtain the third deployment depth.

Referring to FIG. 19 control circuit 200 is mounted in canister 30 and has interlocking button switches 202, 204 mounted in the wall of canister 30 and manually accessible from outside of canister 30. A display 206 is mounted in the wall of canister 30 and viewable from outside thereof and is coupled to circuit 200 and provided with depth selection information for display. Battery 32 is coupled to circuit 200 to power and initiate its control function and motor 86 is coupled to circuit 200 to receive rotative control signals.

When switch 202 is closed circuit 200 is set for the second deployment depth and when switch 204 is closed circuit 200 is set for the third deployment depth. Display 206 displays the depth selected. When sonobuoy 20 is immersed in salt water, battery 32 is activated and powers circuit 200 and initiates its control function as set by switches 202, 204. If circuit 200 has been set by switch 202, a signal is provided to motor 86 to actuate it in a counterclockwise rotative direction and if circuit 200 was set by switch 204 a signal is provided to motor 86 to actuate it in a clockwise rotative direction. If neither switch 202 nor 204 has been closed to set circuit 200, no actuating signal is provided to motor 86 and it will not rotate in either direction which corresponds to the first deployment depth as explained above.

Although the invention is described in a passive type sonobuoy embodiment, its use is not so limited. It can for example be used in active type sonobuoys as well as air launched buoys other than sonobuoys. This invention can also be used with buoys other than sonobuoys. This invention can also be used with buoys having an air descent control means other than the described parachute and can also be used in buoys having other types of surface float means such as for example an inflatable surface float. In addition, this invention may be actuated by any desired type of drive motor.

Figure 20:
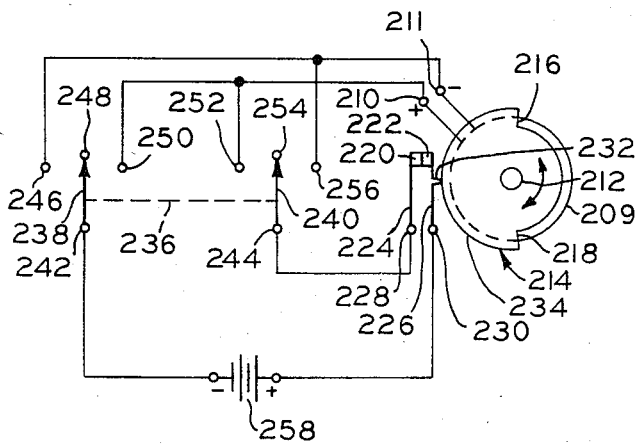
FIG. 20 is a schematic diagram of a bidirectional motor system for use in this invention.
Figure 3:
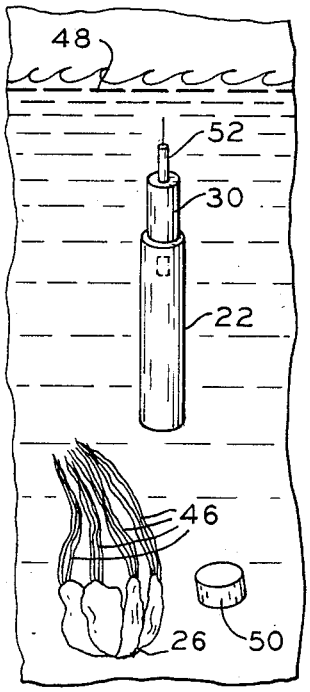
FIG. 3 is a view in perspective of the sonobuoy of FIG. 2 after it has entered the water and the parachute has been ejected.

Referring to FIG. 20 another system for bidirectional rotation of post 124 and rotor 108 is shown. DC motor 209 which may be a low rpm motor or geared down to a low rpm has + terminal 210, − terminal 211 and rotatably drives a rotatable shaft 212. Motor 209 is mounted similarly to motor 86 so that shaft 212 is connected to and rotatably drives post 124, rotor 108 and limit switch cam 214 which has inwardly formed shoulders 216, 218.

Electrical contacts 220, 222 are at the ends of contact arms 224, 226, respectively which are connected to terminals 228, 230 respectively. Arm 224 is stiff while arm 226 is resilient and is spring loaded so that contact 222 is urged away from contact 220. Arm 226 has cam riding neb 232 that rides the outer surface 234 of cam 214 between shoulders 216, 218 to hold contacts 220, 222 closed. When neb 232 reaches either of shoulders 216, 218 contacts 220, 222 open to stop motor 209.

Double pole triple throw switch 236 has ganged switch blades 238, 240 which are pivoted at poles 242, 244 respectively. Blade 238 contacts terminals 246, 248, 250 when blade 240 contacts terminals 252, 254, 256 respectively. Sea water activated battery 258 has its + terminal connected to terminal 230 and its negative terminal connected to pole 242. Pole 244 is connected to terminal 228.

Shaft 212 is shown in its center position corresponding to the FIG. 15 position of rotor 108, blades 238, 240 being preswitched to terminals 248, 254 respectively. When it is desired that rotor 108 be in the position shown in FIG. 18, blades 238, 240 are preswitched to terminals 246, 252, respectively, connecting the negative terminal of battery 258 to negative motor terminal 211 and connecting the positive terminal of battery 258 to positive motor terminal 210 through contacts 220, 222, blade 240 and terminal 252 to impart, after immersion of battery 258, counterclockwise drive to shaft 212 until neb 232 registers with shoulder 218 after approximately 95° of counterclockwise rotation whereat contacts 220, 222 open and motor 209 is stopped. When it is desired that rotor 108 be in the position shown in FIG. 16, blades 238, 240 are preswitched to terminals 250, 256, respectively, connecting the negative terminal of battery 258 to positive motor terminal 210 and connecting the positive terminal of battery 258 to negative motor terminal 211 through contacts 220, 222, blade 240 and terminal 256 to impart, after immersion of battery 258, clockwise drive to shaft 212 until neb 232 registers with shoulder 216 after approximately 95° of clockwise rotation whereat contacts 220, 222 open and motor 209 is stopped.

As mentioned other motors or devices known in the art for imparting the required bidirectional rotation to rotor 108 may be used, the motor or device chosen depending on the particular sonobuoy requirements.

While there have been described above the principles of this invention in connection with specific embodiments, it is to be understood that this is by way of example and is not limiting of the scope of this invention.

What is claimed is:

1. Deployment apparatus for a sonobuoy having a surface component and an underwater component comprising:

first means for containing a length of deployment cable coupled between the sonobuoy surface component and the sonobuoy underwater component;

second means for releasably attaching said first means to the surface component;

third means for releasably attaching said cable at a point intermediate of said cable length to said first means;

fourth means for selectively actuating said second means to release said first means from the surface component and actuating said third means to release the attachment of said cable from said first means whereby when neither said second means nor said third means is actuated said underwater component will be at a first depth, when said second means is actuated and said third means is not actuated said underwater component will be at a second depth and when said second means and said third means are actuated said underwater component will be at a third depth.

2. Deployment apparatus for a sonobuoy comprising a surface float canister having an upper end and a bottom end and an end to end axis;

an hydrophone;

a length of deployment cable coupled between said canister and said hydrophone;

first means for containing a coil of said cable;

second means for releasably attaching said first means to said canister;

third means for releasably attaching said cable at a point intermediate of said cable length in said coil to said first means;

fourth means for selectively actuating said second means to release said first means from the surface component and actuating said third means to release the attachment of said cable from said first means whereby when neither said second means nor said third means is actuated said hydrophone will be at a first depth, when said second means is actuated and said third means is not actuated said hydrophone will be at a second depth and when said second means and said third means are actuated said hydrophone will be at a third depth.

3. The apparatus of claim 1 wherein the surface component comprises a generally cylindrical float canister having an axis and a bottom end.

4. The apparatus of claim 2 wherein said second means comprises a generally cylindrical container having an upper end and a bottom end and an end to end axis;

a first inwardly extending lip mounted to the inner surface of and adjacent the upper end of said container, a rotor rotatably mounted to said canister bottom end and rotatable about a rotor axis substantially parallel to said canister axis; a rod pivotally carried at one end by said rotor and at the other end contacting the underside of said lip when said rotor is in a first rotative position and clear of said lip when said rotor is in a second rotative position; a second inwardly extending lip mounted to the inner side of said container substantially diametrically opposite to said first lip; said rotor having a portion contacting the underside of said second lip in said first rotative position and clear of said second lip in said second rotative position whereby when said rotor is in said first rotative position said canister bottom end is latched to said upper end of said container and when said rotor is in said second rotative position said canister and container are unlatched and separated for movement apart from one another.

5. The apparatus of claim 4 wherein said third means comprises a bracket mounted to the inside surface of said container depending from said second lip; a wire mounted for rotation about its longitudinal axis which is substantially parallel to said container axis at two spaced points in said bracket, said points being on the longitudinal wire axis; said wire having a looped head; spring means mounted in said bracket for urging said head against the underside of said second lip;

said third means further comprising a lanyard attached at a first end to said intermediate point of said cable and looped at a second end about said wire between said two spaced points so that said loop is captured on said wire between said spaced points; a first notch being formed in said rotor for engaging said head and swinging said head about said wire axis and rotating said wire about said wire axis as said rotor is rotated;

a second notch being in said second lip;

said fourth means for rotating said rotor to a third rotative position at which said head is aligned with said second notch whereby said head under said spring force is urged into and through said second notch and said wire is moved from between said two spaced points releasing said lanyard and said rotor portion is clear of said second lip and said rod is clear of said first lip releasing said canister from said container whereby said canister and said container become separated and full length deployment of said cable is provided.

6. The apparatus of claim 5 wherein said head becomes aligned with said second notch during rotation of said rotor to said third rotative position.

7. The apparatus of claim 6 wherein said second rotative position is in one rotative direction about said rotor axis from said first rotative position; said third rotative position is in the opposite rotative direction from said one direction from said first rotative position.

8. The apparatus of claim 7 wherein said rotor is wedge shaped and has a narrow end and a wide end; said rotor portion comprising said wide end; said rod one end being pivotally carried by said narrow end; said first notch being funnel shaped and formed in said wide end; said second notch being V shaped and positioned in said second lip between said first and third rotative positions whereby said head will enter said second notch only upon rotation of said rotor from said first to said third rotative positions.

9. The apparatus of claim 8 wherein said lanyard comprises a tubular woven fabric; said cable being inserted through a portion of said lanyard; said lanyard portion fabric progressively contracting in diameter and tightening on said cable as said cable is pulled in a deployment direction through said lanyard portion whereby said lanyard portion is firmly attached to said cable.

10. The apparatus of claim 9 including a rod guide mounted to said canister bottom; said guide having a guide hole through which said rod extends for guiding movement of said rod second end and for maintaining said rod in contact with the underside of said first lip.

11. Deployment apparatus for a sonobuoy having a surface component and an underwater component comprising:

first means for containing a length of deployment cable; said cable being coupled between the surface component and the underwater component;

second means mounted in said first means for controlling payout of first and second predetermined lengths of the cable for deploying said underwater component at corresponding first and second predetermined depths;

said second means comprising a shaft mounted for rotation in said first means and rotatable in a first rotative direction from an initial rotative position to a first selected rotative position and rotatable in a second rotative direction opposite to said first rotative direction to a second rotative position; rotating means coupled to said shaft for selectively rotating said shaft in said first rotative direction from said initial rotative position to said first selected rotative position and for rotating said shaft in said second rotative direction to said second rotative position; attaching and releasing means coupled to and operable by said shaft for releasably preventing payout of said first and second predetermined lengths of the cable; said attaching and releasing means being operable to release payout of said first predetermined length of cable only when said shaft is in said first rotative position and to release payout of said second predetermined length of cable only when said shaft is in said second rotative position whereby a corresponding predetermined length of cable payout is provided for each selected rotative position of said shaft.

* * * * *